US005229556A

United States Patent [19]

Geddes

[11] Patent Number: 5,229,556

[45] Date of Patent: Jul. 20, 1993

[54] INTERNAL PORTED BAND PASS ENCLOSURE FOR SOUND CANCELLATION

[75] Inventor: Earl R. Geddes, Livonia, Mich.

[73] Assignee: Ford Motor Company, Dearborn, Mich.

[21] Appl. No.: 894,888

[22] Filed: Jun. 8, 1992

Related U.S. Application Data

[63] Continuation-in-part of Ser. No. 514,624, Apr. 25, 1990, Pat. No. 5,119,902, and a continuation-in-part of Ser. No. 868,151, Apr. 14, 1992.

[51] Int. Cl.[5] ..... F01N 1/06

[52] U.S. Cl. ..... 181/206; 381/71

[58] Field of Search ..... 181/206, 255, 269; 381/71

[56] References Cited

U.S. PATENT DOCUMENTS

| | | | |
|---|---|---|---|
| 1,969,704 | 8/1934 | D'Alton | 181/156 |
| 4,153,815 | 5/1979 | Chaplin et al. | 381/71 |
| 4,473,906 | 9/1984 | Warnaka et al. | 181/206 |
| 4,480,333 | 10/1984 | Ross | 381/71 |
| 4,549,631 | 10/1985 | Bose | 181/156 |
| 4,665,549 | 5/1987 | Eriksson et al. | 381/71 |
| 4,669,122 | 5/1987 | Swinbanks | 381/71 |
| 4,677,676 | 6/1987 | Eriksson | 381/71 |
| 4,677,677 | 6/1987 | Eriksson | 381/71 |
| 4,736,431 | 4/1988 | Allie et al. | 381/71 |
| 4,783,817 | 11/1988 | Hamada et al. | 381/71 |
| 4,805,733 | 2/1989 | Kato et al. | 181/206 |
| 4,815,139 | 3/1989 | Eriksson et al. | 381/71 |
| 4,837,834 | 6/1989 | Allie | 381/71 |
| 4,875,546 | 10/1989 | Krnan | 181/160 |
| 4,876,722 | 10/1989 | Dekker et al. | 381/71 |
| 4,878,188 | 10/1989 | Ziegler, Jr. | 364/724 |
| 5,025,885 | 6/1991 | Froeschle | 181/156 |
| 5,119,902 | 6/1992 | Geddes | 181/206 |

FOREIGN PATENT DOCUMENTS

| | | |
|---|---|---|
| 768373 | 8/1934 | France . |
| 2191063 | 12/1987 | United Kingdom . |

*Primary Examiner*—Michael L. Gellner
*Assistant Examiner*—Khanh Dang
*Attorney, Agent, or Firm*—Roger L. May; Mark L. Mollon

[57] ABSTRACT

A transducer arrangement for active noise cancellation in conduits, for example, in motor vehicles where an electronic control produces a drive signal for a transducer that emits cancellation pulses phased 180° from the sound pressure pulses passing through an exhaust conduit, where both front and rear sides of the transducer are acoustically coupled to improve the efficiency of the transducer operation. Preferably, the acoustic coupling comprises an enclosed chamber partitioned to expose a first transducer side to a chamber portion and a second transducer side to a second chamber portion. A first port couples one of the chambers to the other and a second port couples one of the chambers to the conduit. Each port for communicating with the conduit can be tuned to resonate at predetermined frequencies. When both sides of the transducer are so coupled to the conduit, the transducer has increased efficiency over a band of frequencies, to accommodate the frequencies generated by a source of noise while limiting access of fluid or heat in the conduit to the transducer. A tandem transducer mounting arrangement according to the present invention reduces vibration of the housing. The system is particularly suitable for use in adapting noise cancellation techniques to replace or combine with passive mufflers on motor vehicles.

15 Claims, 1 Drawing Sheet

FIG 1
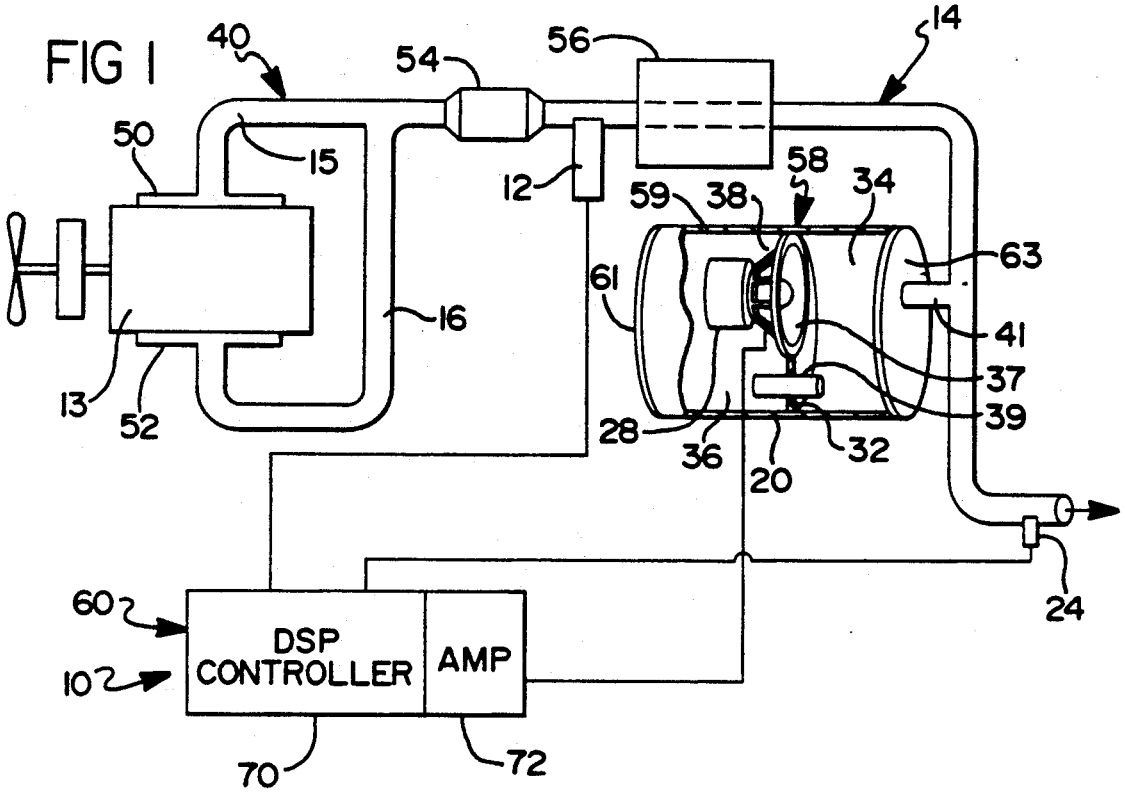
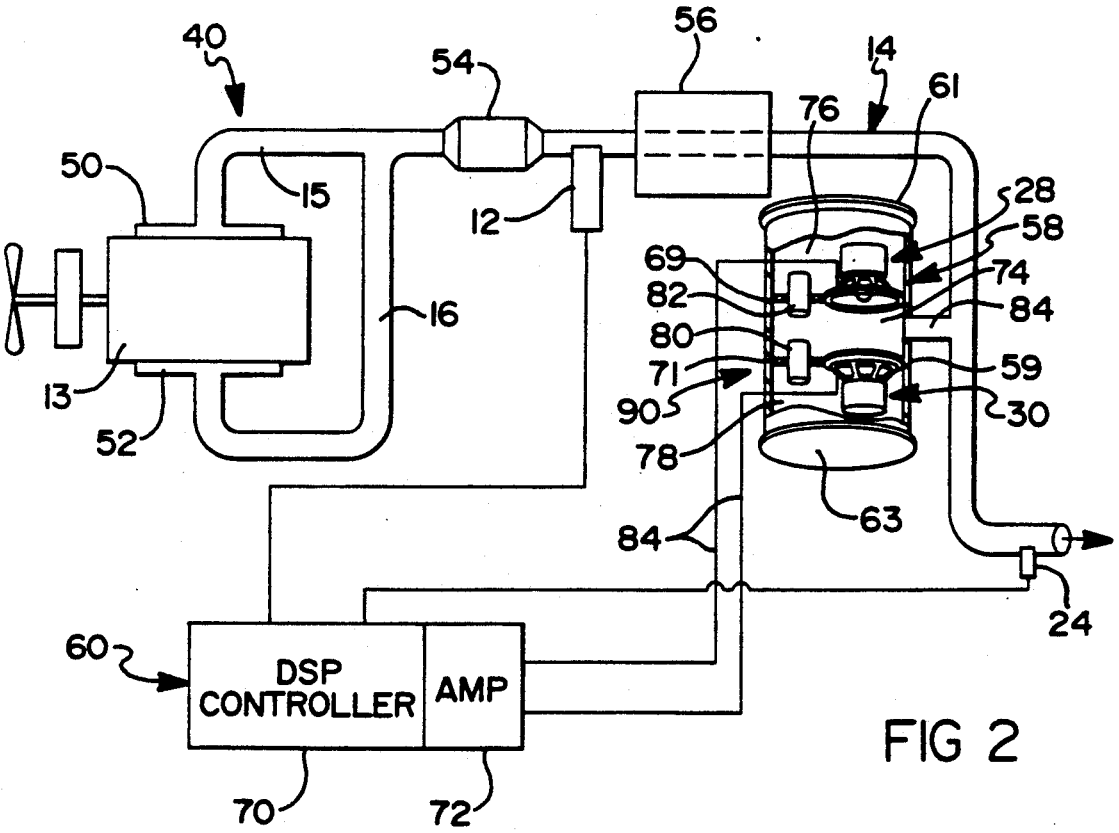
FIG 2

INTERNAL PORTED BAND PASS ENCLOSURE FOR SOUND CANCELLATION

CROSS REFERENCE TO RELATED APPLICATIONS

The present application is a continuation-in-part of application Ser. No. 514,624, filed Apr. 25, 1990 entitled "Active Muffler Transducer Arrangement", now U.S. Pat. No. 5,119,902, and U.S. application Ser. No. 868,151, filed Apr. 14, 1992 entitled "Tandem Transducer Magnet Structure".

TECHNICAL FIELD

The present invention relates generally to noise reduction apparatus, and more particularly to transducer constructions for active sound cancellation devices made applicable for use with motor vehicles.

BACKGROUND ART

Internal combustion engines typically used in motor vehicles generate a substantial amount of noise due to the combustion occurring within the engine. Conventionally, the noise generated is suppressed by a passive muffler system in which the sound waves are broken up by resonance with baffles, passageways and the like or absorbed by fibrous material. However, such techniques of reducing the sound level also obstruct the free flow of exhaust gases through the exhaust conduits and therefore substantially interfere with efficient operation of the vehicle engine by interfering with the release of combustion products and inhibiting the replacement of the combusted gases with fresh fuel in the engine cylinders. Nevertheless, despite the reduction in economy and performance, the need for substantially reduced noise levels requires the use of mufflers on all production motor vehicles.

Although active noise cancellation systems have been employed with large ducts used for heating and ventilation in large buildings, the previously known systems are not well adapted for use in the environment of motor vehicles. For example, Warnaka et al. U.S. Pat. No. 4,473,906 discloses numerous prior art sound attenuation system embodiments. In general, sensed sound pressure produces a signal adapted to drive a loudspeaker for inputting cancellation signals into the duct. The cancellation signal is an acoustic pulse signal 180° out of phase with the signal passing past the speaker through the duct. The prior art embodiments also illustrate improved noise attenuation performance by reducing the effect of the feedback of the cancellation signal which arrives at the sensor. The patent discusses the inclusion of additional transducers and electronic controls to improve the performance of the active acoustic attenuator.

Eriksson U.S. Pat. No. 4,677,677 further improves attenuation by including an adaptive filter with on-line modeling of the error path and the canceling speaker by using a recursive algorithm without dedicated off-line pretraining. U.S. Pat. No. 4,677,676 adds a low amplitude, uncorrelated random noise source to a system to improve performance. Likewise, Decker et al U.S. Pat. Nos. 4,876,722 and Hamada et al. 4,783,817 disclose particular component locations which are performance related but do not adapt active attenuator noise control systems to motor vehicles.

However, none of these improvements render the system applicable to muffle engine noise in the environment of a motor vehicle. For example, such systems often employ extremely large transducers such as 12 or 15 inch loudspeakers of conventional construction. Such components are not well adapted for packaging within the confines of the motor vehicle, and particularly, within the undercarriage of the motor vehicle. Moreover, since the lowest frequency of the signal to be cancelled is on the order of 25 hertz, a large loudspeaker is used to generate sound signals with sufficient amplitude in that range, and such speakers are not practical to mount beneath a motor vehicle. Moreover, although the highest frequencies encountered are easier to dissipate because of their smaller wavelength, the highest frequency to be cancelled is on the order of 250 hertz.

Moreover, many of the above-mentioned systems locate the speakers within the ducts subjected to the sound pressure signal. The loudspeakers conventionally employed in those systems would not fit within conventional exhaust conduits for motor vehicles. Furthermore, the harsh environmental conditions within such a chamber would adversely affect the described known systems and diminish their performance in a motor vehicle.

Although there have been known techniques for increasing the efficiency of audio loudspeakers, those teachings have not been considered readily applicable to active noise attenuating systems. French Patent No. 768,373 to D'Alton, Bose U.S. Pat. No. 4,549,631 and the Bandpass Loudspeaker Enclosures publication of Geddes and Fawcett presented at the 1986 convention of the Audio Engineering Society acknowledge the phenomena of tuning loudspeaker output by the use of chambers including ports. Two loudspeakers having chambers, a connecting port and an output port are disclosed in U.S. Pat. Nos. 4,875,546 and 5,025,885. The recognition of this tuning phenomena has been limited to its effect upon audio reproduction, and particularly dispersion of the audio signal to an open area outside the loudspeaker enclosure. The closed conduit system of motor vehicle exhaust systems, and the harsh conditions associated with such systems, is a substantially different environment.

In addition, my above-identified copending applications discuss improvements and the advantages to be obtained by ported communication between multiple transducer faces and an exhaust conduit. However, the mounting of multiple transducers increases the packaging problems, material costs and assembly complexity of the vehicle. Furthermore, a back to back alignment of transducers may position the magnets so that the magnetic fields may interfere with efficient operation of the transducers. However, these problems and the solutions presented do not address the problems of exposing the transducer to mediums and temperatures carried by conduits, particularly those in motor vehicle systems.

SUMMARY OF THE INVENTION

The present invention substantially reduces the difficulty of employing active attenuation technology to motor vehicle exhaust systems by using the front and rear emissions from at least one transducer to effect cancellation of sound pressure pulses in a conduit enclosure. In general, a transducer is enclosed in a housing defining a chamber. Each transducer has a diaphragm with a first side exposed to a first chamber portion partly defined by a partition in the enclosure. The transducer diaphragm has a second side exposed to a second chamber portion partly defined by the partition. A first port couples the first chamber portion to the second chamber portion. A second port couples one of the chamber portions to the conduit for communicating the sound cancellation pressure pulses to the conduit. Preferably, the ported chambers are tuned for high and low ends, respectively, of the frequency band of the sound pressure pulses to be cancelled.

The number of transducers carried in the housing of the transducer arrangement may be varied. The number of subchambers is preferably defined in a manner to permit each transducer diaphragm surface to be exposed to a subchamber, although multiple transducer diaphragms may communicate with a single chamber portion. Moreover, each subchamber is preferably ported to another subchamber or to the conduit. However, the present invention provides the particular advantage that the number of ports communicating with the conduit can be limited without substantially affecting the cancellation signal output throughout the bandwidth of the cancellation signal.

The present invention is particularly useful for protecting the transducer portions which are most susceptible to damage due to high temperature or corrosive environments which may be delivered through the conduits. In particular, the joint between the coil sleeve and the diaphragm of the transducer, usually carried by a transducer frame adjacent a back side of the diaphragm, may be protected from the highest temperature fluid by exposure only to a subchamber coupled by an internal port to another subchamber. As a result, the transducer arrangement provides a simpler arrangement than protective membranes or other devices preventing direct fluid contact between the conduit and the chambers of the transducer arrangement.

BRIEF DESCRIPTION OF THE DRAWINGS

The present invention will be more clearly understood by reference to the following detailed description when read in conjunction with the accompanying drawing in which like reference characters refer to like parts throughout the views and in which:

FIG. 1 is a diagrammatic view of a motor vehicle exhaust system including an active cancellation system with a transducer arrangement according to the present invention; and FIG. 2 is a diagrammatic view similar to FIG. 1 but showing further modification of the transducer arrangement according to the present invention.

DETAILED DESCRIPTION OF THE BEST MODE

As shown in the drawing, the transducer arrangement of the present invention is shown applied to a motor vehicle exhaust system. Nevertheless, it is to be understood that the preferred implementation of the invention is not intended to be a limitation of the invention, and it will be readily understood that other fluid systems using a conduit can also benefit from the use of the present invention. Moreover, while the drawing illustrates the transducer arrangement used as the output of sound cancellation system in the preferred embodiment, it will also be understood that the transducer arrangement can be applied for the conversion of sound pressure pulses to electrical signals as well as the conversion of electrical signals to sound pressure pulses.

Referring to FIG. 1, the exhaust system 40 for a motor vehicle engine 13 includes the common exhaust conduit 14 coupled to exhaust pipes 15 and 16 communicating with the exhaust manifolds 50 and 52, respectively. The common exhaust conduit 14 refers generally to the path communicating with the exhaust pipes 15 and 16 regardless of the individual components forming the passageway through which the exhaust gases pass. For example, the catalytic converter 54 and the muffler accessory 56 form part of the conduit 14, while the transducer assembly 20 includes an active noise cancellation transducer housing 58 connected for fluid communication with the conduit 14. However, the housing 58, constructed with a cylindrical wall 59 enclosed by end walls 61 and 63 in the preferred embodiment, could also be constructed to support or form part of the conduit 14. Furthermore, the catalytic converter 54 and the passive muffler accessory 56 may be of conventional construction for such items and need not be limited to a particular conventional construction. For example, simple noise damping insulation can be carried in a closed container, for example, to reduce vibrations in susceptible portions of the conduit 14. In addition, combining the passive muffler accessory 56 with an active noise cancellation system can more effectively reduce the high frequency components of the noise signal.

In addition, the exhaust system 40 includes an active noise cancellation system 10 with a controller 60 cooperating with a sensor 12 and feedback sensor 24 as well as the tandem transducer arrangement 20 carried by the transducer housing 58. The electronic control 60 includes a digital signal processing (DSP) controller 70 generating a signal responsive to the sensor signal representative of detected noise in order to generate an out of phase cancellation signal. In addition, the controller 70 includes an amplifier circuit 72 that provides sufficient amplitude to the drive signal for the transducers in the tandem transducer arrangement 20 to match the amplitude of pressure pulses passing the locations at which the transducer arrangement 20 communicates with the conduit 14.

The transducer arrangement 20 includes a transducer 28 mounted in the housing 58 enclosing the chamber 31. The chamber 31 is divided by a partition 32 to form a first chamber portion 34 and a second chamber portion 36. The partition 32 also carries the transducer 28 at the interface of the front and rear sides of the transducer diaphragm. As a result, the front side 37 is exposed to the chamber portion 34 while the rear side 38 is exposed to the chamber portion 36. The partition 32 also carries a tube 39 forming a first port communicating between the chamber portion 34 and the chamber portion 36. In addition, the end wall 63 carries an elongated tubular port 41 communicating between the chamber 34 and the conduit 14.

The rear side 38 of the transducer diaphragm faces the rear of the transducer 28 which carries the magnet, the coil and the junction between the diaphragm and the coil sleeve. In addition, the rear of the transducer includes the frame for carrying the diaphragm and carries electrical conductors, the magnet and the other components such as electrical terminals.

In addition, an optional membrane of the type described to my co-pending application entitled "Transducer Membrane", filed concurrently, incorporated by reference herein, may be positioned in the chamber portion 34 between the port 41 and the sound pressure sources diaphragm side 37 and port 39. In addition, chamber portion 34 and port 41 are preferably tuned for resonance near the upper end of the spectrum of the cancellation signal whereas the internal port 39 and chamber portion 36 are tuned at or near the lower end of the frequency band width in the cancellation signal.

In accordance with the teachings of my previous applications, the faces may be enclosed in separate chambers communicating with the conduit through ports. As a result, the output from each enclosure can be tuned, since for a given port area, the resonant frequency is proportional to $(L.V)^{-\frac{1}{2}}$, where L is the length of the port and V is the volume of the chamber. Preferably, two ports with two differently tuned chambers provides greater efficiency over the entire bandwidth of the cancellation signals.

In the preferred embodiment shown, both the front and rear sides of the transducer are coupled through ported chambers as previously discussed, the outlets of the ports communicating with opposite sides of the speaker preferably communicate with the conduit through a single port. Such an arrangement provides substantially double the efficiency of a standard transducer noise cancellation set-up using output from a single side of a transducer or loudspeaker.

Moreover, the frequency band throughout which the increased efficiency occurs may be extended at the lower end (F1) and cut-off at an upper end (F2). The high cut-off frequency F2 is proportional to $(V1.L1)^{-\frac{1}{2}}$. For the purposes of motor vehicle engine exhaust, a conventional internal combustion engine exhaust valve would generate a maximum frequency of about 250 hertz.

Similarly, the lowest frequency F1 would be proportional to the $(V2.L2)^{-178}$. Typically, it will be determined as a function of a convenient idle speed for the motor vehicle engine. As a result, volumes V1 and V2 of the chambers 34 and 36, respectively, as well as the lengths L1 and L2 of the ports 41 and 39, respectively, will be determined as necessary to provide increased efficiency throughout the frequency band width of the sound pressure pulses passed through the exhaust conduit 14.

The best performance of such a system will occur where L2 should be substantially less than the half wavelength of the highest frequency F2 to avoid standing wave resonance in the port.

As a result of the tuning provided by the ported chambers of the transducer mounting arrangement of the present invention, the efficiency of the transducer is substantially increased. Thus, the size of the transducer and the energy required to operate the transducer can be substantially reduced over required transducers in previously known noise cancellation systems. In particular, the reduction of energy input requirements substantially reduces the need for power amplification components which are typically the most expensive portions of the electronic control 60. Moreover, the limited space available for packaging such components in a motor vehicle does not prevent the application of an active noise attenuation system in motor vehicles as was expected from previously known noise cancellation systems. Moreover, the limited port access to the housing defining the chambers can be used to reduce the effect of heat and other environmental conditions which reduce the useful life of the transducer or other components of the noise cancellation system.

As shown in FIG. 2, the housing 58 of transducer arrangement 90 includes a cylindrical wall 59 and enclosing end walls 61 and 63. The cylindrical wall peripherally engages partitioning walls 69 and 71 carrying the transducers 28 and 30 at the interface between the front and rear sides of each transducer diaphragm. As shown in FIG. 2, the transducers 28 and 30 preferably face each other in coaxial alignment so that the front sides of each transducer communicate with the same chamber 74. Moreover, the rear side 38 of transducer 28 is separated from its front side and communicates with chamber 76 defined by cylindrical wall 59, end wall 61 and the partitioning wall 69 carrying transducer 28. Similarly, the back side of the transducer 30 is separated from the front side by mounting in partitioning wall 71 and is exposed to the chamber 78 defined by cylindrical wall 59, end wall 63 and the partitioning wall 71 carrying transducer 68.

Nevertheless, it is to be understood that the speakers could be supported by means other than partition walls so long as the front and rear sides of the diaphragm are exposed to separate chambers within an enclosed housing. Furthermore, it will be understood that the transducers could also be aligned in other positions producing similar results. For example, the speakers could face in the same direction but with oppositely wound coils or reversed polarity terminals so that the front side of one speaker facing the rear side of the other speaker moves in the opposite direction in the common chamber 74. Accordingly, either front or rear sides of a transducer could complement a side of the other speaker in common chamber 74, and serve to counteract the vibration of the housing.

As also shown in FIG. 2, the chamber 76 communicates through a port formed by a tube 82 carried by partition wall 69 with the common chamber 74. The chamber 78 communicates through a similar port 80 carried by partition wall 71 with the common chamber 74. With such a porting arrangement, a port 84 in the form of a tube carried by peripheral wall 59 couples chamber 74 in communication with the exhaust conduit 44.

Furthermore, it is preferable to tune the chamber 74 and port 84 near the highest frequency of the cancellation signal bandwidth. Since the resonant frequency is proportional to $(L.V)^{-178}$ for a given tuning duct area as previously discussed, proper dimensioning of the chamber and the port enables the signals emanating from the front sides of the transducers 28 and 30 to demonstrate improved transducer efficiency in a predetermined range, preferably the range at or near the highest cutoff frequency in the cancellation signal bandwidth. In addition, the ports 80 and 82 are preferably symmetrically tuned at a frequency at or near the lowest cutoff frequency in the cancellation signal bandwidth. Such tuning minimizes the need for more powerful electronics in the amplifier 72.

In any event, the equal and opposite reactions of the diaphragms in transducers 28 and 30 in FIG. 2 eliminates the substantial vibration of the housing 58 induced by operation of a single transducer. The equal but opposite displacement of the transducer diaphragms faces avoids unopposed vibration of the housing walls forming the housing 58. As a result, the arrangement limits the associated audible noise, displacement and physical forces which would be generated as a result of transducer diaphragm displacements transferred to the housing in which it is mounted. Nevertheless, the fluid communication between the conduit 14 and other components is limited by the porting arrangement of the present invention while acoustic energy is communicated to the conduit.

Having thus described the present invention, many modifications thereto will become apparent to those skilled in the art to which it pertains without departing from the scope and spirit of the present invention as defined in the appended claims.

I claim:

1. A transducer arrangement for motor vehicles including an active noise cancellation system for cancelling noise propagating through a conduit, the transducer arrangement comprising:

a housing defining an enclosed chamber;

at least one transducer having a diaphragm;

a transducer mount for partitioning said enclosed chamber at said diaphragm, to form a first chamber section exposed to one side of said diaphragm and a second chamber section exposed to the other side of said diaphragm;

a first port coupling said first chamber section in communication with said second chamber section;

a second port coupling one of said first and second chamber portions in communication with the conduit.

2. The invention as described in claim 1 and further comprising a membrane partitioning said one chamber portion to separate at least one of said first port and said diaphragm side exposed to said one chamber portion from said second port.

3. The invention as described in claim 2 wherein said membrane partitions both said first port and said exposed side of said diaphragm side exposed to said one chamber from said second port.

4. The invention as described in claim 1 wherein the conduit is an exhaust conduit carrying combustion gases.

5. The invention as described in claim 1 wherein said at least one transducer comprises two transducers and wherein one side of each transducer diaphragm is exposed to a common chamber portion.

6. The invention as described in claim 5 wherein said second port couples said common chamber to said conduit.

7. The invention as described in claim 1 wherein said transducer has a front side and a rear side and wherein said second port communicates with a chamber portion exposed to said front side of said speaker.

8. The invention as described in claim 6 wherein each said transducer has a front side and a rear side and wherein said common chamber is exposed to the front side of each said transducer.

9. The invention as described in claim 6 wherein said second port and said common chamber are tuned to a resonance frequency near an upper end of a cancellation signal frequency spectrum.

10. A sound cancellation system for sound pressure waves propagating through a conduit comprising:

a detector transducer for sensing the sound pressure waves and generating a control signal in response to the sound pressure waves detected;

control means for generating a drive signal in response to said control signal;

a transducer coupled to receive said control signal;

said transducer being mounted in an enclosure defining a chamber, said chamber having a partition separating a first portion of said chamber from a second portion of said chamber, wherein said transducer has a diaphragm with a first side facing said first chamber portion, and with a second side facing said second subchamber;

a first port coupling said first chamber portion to said second chamber portion, and a second port coupling one of said first and second chamber portions to the conduit.

11. The invention as described in claim 10 wherein at least one membrane partitions said one of said first and second chamber portions separate said transducer from fluid communication with the conduit.

12. The invention as described in claim 10 wherein said transducer has a front side and a rear side and said one of said first and second chamber portions is exposed to said front side.

13. A muffler system for a motor vehicle exhaust conduit, comprising:

a detector transducer for generating a control signal in response to sound pressure waves propagating through the conduit;

an electronic control for generating a drive signal in response to said control signal;

a transducer for generating a cancellation signal in response to said drive signal;

wherein at least one of said transducers is mounted in an enclosure defining a chamber, said enclosure including a partition and forming a first chamber portion communicating with one side of the transducer's diaphragm and a second chamber portion communicating with a second side of the transducers diaphragm, a first port communicating between said first chamber portion and said second chamber portion, a second port coupling one of said first and second chamber portions to said conduit.

14. The invention as described in claim 13 wherein at least one membrane partitions said one of said first and second chamber portions to separate said at least one transducer from fluid communication with said conduit.

15. The invention as described in claim 14 wherein said at least one transducer has a front side and a rear side and said one of said first and second chamber portions is exposed to said front side.

* * * * *

UNITED STATES PATENT AND TRADEMARK OFFICE

CERTIFICATE OF CORRECTION

PATENT NO. : 5,229,556

DATED : July 20, 1993

INVENTOR(S) : Earl R. Geddes

It is certified that error appears in the above-indentified patent and that said Letters Patent is hereby corrected as shown below:

Column 5, line 9, after "to" delete "$(L.V)^{-1/2}$" and substitute --$(L \cdot V)^{-1/2}$--.

Column 5, line 26, after "to" delete "$(V1.L1)^{-1/2}$" and substitute --$(V1 \cdot L1)^{-1/2}$--.

Column 5, line 32, after "to" delete "$(V2.L2)^{-1/2}$" and substitute --$(V2 \cdot L2)^{-1/2}$--.

Column 6, line 42, after "to" delete "$(L.V)^{-178}$" and substitute --$(L \cdot V)^{-1/2}$--.

Column 8, line 22, Claim 11, before "separate" insert --to--.

Column 8, line 42, Claim 13, delete "transducers" and substitute --transducer's--.

Signed and Sealed this

Twenty-sixth Day of April, 1994

Bruce Lehman

*Attest:*

BRUCE LEHMAN

*Attesting Officer*

*Commissioner of Patents and Trademarks*